US008941039B2

(12) United States Patent
Galbreath et al.

(10) Patent No.: US 8,941,039 B2
(45) Date of Patent: Jan. 27, 2015

(54) DEVICE AND IMPLEMENTATION THEREOF FOR REPAIRING DAMAGE IN A COOKING APPLIANCE

(75) Inventors: Patrick Galbreath, Louisville, KY (US); Mark Heimerdinger, Louisville, KY (US)

(73) Assignee: General Electric Company, Schenectady, NY (US)

( * ) Notice: Subject to any disclaimer, the term of this patent is extended or adjusted under 35 U.S.C. 154(b) by 635 days.

(21) Appl. No.: 12/848,470

(22) Filed: Aug. 2, 2010

(65) Prior Publication Data

US 2012/0024844 A1 Feb. 2, 2012

(51) Int. Cl.

| | |
|---|---|
| ***H05B 6/70*** | (2006.01) |
| ***H05B 6/64*** | (2006.01) |
| ***H05B 6/76*** | (2006.01) |

(52) U.S. Cl.

CPC ..... *H05B 6/6402* (2013.01); *H05B 6/76* (2013.01)

USPC ..... 219/690; 219/697; 219/681; 219/710; 219/757

(58) Field of Classification Search

USPC ..... 219/690, 697, 681, 710, 757

See application file for complete search history.

(56) References Cited

U.S. PATENT DOCUMENTS

| | | | | |
|---|---|---|---|---|
| 2,593,067 | A * | 4/1952 | Spencer | 219/750 |
| 2,704,802 | A * | 3/1955 | Blass et al. | 219/748 |
| 3,182,164 | A * | 5/1965 | Ironfield | 219/741 |
| 3,235,701 | A * | 2/1966 | Duras et al. | 219/746 |
| 3,469,053 | A * | 9/1969 | Levinson | 219/746 |
| 3,585,258 | A * | 6/1971 | Levinson | 264/432 |
| 3,764,770 | A * | 10/1973 | Saad et al. | 219/750 |
| 3,843,862 | A | 10/1974 | Staats et al. | |
| 4,028,519 | A | 6/1977 | De Weese et al. | |
| 4,301,347 | A * | 11/1981 | Quine | 219/747 |
| 4,430,538 | A * | 2/1984 | Suzuki et al. | 219/749 |
| 4,822,966 | A * | 4/1989 | Matsubara | 219/730 |
| 4,952,763 | A * | 8/1990 | Fritz | 219/697 |
| 4,963,709 | A * | 10/1990 | Kimrey, Jr. | 219/686 |
| 5,420,401 | A * | 5/1995 | Jacquault et al. | 219/756 |
| 5,438,183 | A * | 8/1995 | Hayami et al. | 219/748 |
| 5,468,940 | A * | 11/1995 | Kang | 219/746 |
| 5,742,033 | A * | 4/1998 | Park | 219/746 |
| 5,786,579 | A * | 7/1998 | Park | 219/746 |
| 5,874,715 | A * | 2/1999 | Choi | 219/746 |
| 5,935,479 | A * | 8/1999 | Lee | 219/746 |
| 5,948,310 | A * | 9/1999 | Shon et al. | 219/746 |
| 6,066,841 | A * | 5/2000 | Kim et al. | 219/746 |
| 6,350,973 | B2 * | 2/2002 | Wroe et al. | 219/680 |
| 6,452,142 | B2 * | 9/2002 | Eke | 219/746 |
| 6,614,011 | B2 * | 9/2003 | Omori et al. | 219/748 |
| 6,657,171 | B1 * | 12/2003 | Huynh et al. | 219/746 |
| 6,680,467 | B1 * | 1/2004 | Whipple, Jr. | 219/747 |

(Continued)

*Primary Examiner* — Thao X Le
*Assistant Examiner* — Eric Jones
(74) *Attorney, Agent, or Firm* — GE Global Patent Operation; Marc A. Vivenzio

(57) ABSTRACT

A cooking appliance such as a microwave oven is provided with a sacrificial region for repairing damage caused by arcing and related failure modes. The sacrificial region incorporates a component that, when damaged, is removable from the cooking appliance for replacement by another component of similar construction. In one implementation, a sacrificial component is utilized in a microwave oven with a heated cavity subject to microwave radiation from a magnetron. The sacrificial component in this example includes an aperture that communicates with an opening in the cavity, and through which the radiation impinges into the heated cavity.

20 Claims, 4 Drawing Sheets

(56) References Cited

U.S. PATENT DOCUMENTS

| | | | | |
|---|---|---|---|---|
| 6,909,077 | B2 * | 6/2005 | Eke et al. | 219/746 |
| 6,982,401 | B2 * | 1/2006 | Hu et al. | 219/746 |
| 7,392,760 | B2 * | 7/2008 | Taguchi et al. | 118/723 MW |
| 2001/0045429 | A1 * | 11/2001 | Eke | 219/756 |
| 2007/0137633 | A1 | 6/2007 | McFadden | |
| 2007/0215612 | A1 | 9/2007 | Hicks et al. | |

* cited by examiner

DEVICE AND IMPLEMENTATION THEREOF FOR REPAIRING DAMAGE IN A COOKING APPLIANCE

BACKGROUND OF THE INVENTION

The subject matter disclosed herein relates generally to cooking appliances, and more particularly to the repair of cooking appliances that are subject to arcing and related failure modes.

Cooking appliances outfitted to cook with microwave radiation have components such as magnetrons that can fail by arcing. Magnetron arcing is an instantaneous failure, wherein damage occurs to components nearest the magnetron. These components are typically coupled to or act as an electrical ground. In connection with cooking appliances such as microwaves, arcing can damage portions of the interior cavity where the microwave radiation is focused to cook food. These cavities are often constructed of unitary or monolithic materials (including welded constructions) that, while effective for containing and directing the microwave radiation, are damaged by arcing to the point of non-repair.

Therefore it would be advantageous to provide a cooking appliance that is configured for repair after arcing. It would also be advantageous to construct components for use in the cooking appliance that facilitate such repair, thereby reducing cost and related issues that are caused by arcing.

BRIEF DESCRIPTION OF THE INVENTION

In one embodiment, a cooking appliance comprises a magnetron providing radiation and a heated cavity comprising a cavity wall with an opening exposing the heated cavity to the radiation. The cooking appliance also comprises a sacrificial component having an aperture in communication with the opening, the aperture permitting radiation to pass through the sacrificial component and into the heated cavity. The cooking appliance further described wherein the sacrificial component is removeable from the heated cavity.

In another embodiment, in a microwave oven with a heated cavity for cooking food therein, the heated cavity comprising a cavity wall with a top cavity wall, a bottom cavity wall, a rear cavity wall, and a pair of opposing side cavity walls, the heated cavity exposed to radiation from a magnetron via an opening in the cavity wall, the microwave oven comprises a sacrificial component having an aperture therethrough. The microwave oven further described wherein the aperture is positioned with respect to the opening so as to permit radiation to pass to the heated cavity through the sacrificial component, and wherein the sacrificial component is secured to the heated cavity in a manner that permits the sacrificial component to be removed from said microwave oven.

In yet another embodiment, a microwave oven, comprises a magnetron, a heated cavity receiving radiation from the magnetron, the heated cavity including a cavity wall with an opening exposing the heated cavity to the radiation. The microwave oven also comprises a cover coupled to the cavity wall, the cover having a surface covering the opening, and a plate located between the surface and the cavity wall. The microwave oven further described wherein the plate has an aperture in communication with the opening to permit radiation to pass through the plate and into the heated cavity during operation of the magnetron, and wherein the plate is removable from the heated cavity.

BRIEF DESCRIPTION OF THE DRAWINGS

Reference is now made briefly to the accompanying drawings, in which.

Like reference characters designate identical or corresponding components and units throughout the several views, which are not to scale unless otherwise indicated.

DETAILED DESCRIPTION OF THE INVENTION

Concepts illustrated in the appended drawings, the subject matter illustrated being described in detail below, are implemented in appliances such as microwave ovens, which are subject to arcing and related failures caused by radiative elements, e.g., a magnetron in the microwave oven. Repair required after arcing is facilitated in one example by providing a sacrificial component that is compatible with the function of the magnetron. Should this sacrificial component suffer from failure due to arcing, the appliance is not rendered useless, but rather is configured for servicing to remove and replace the damaged sacrificial component. This repair is beneficial because it results in cost savings to the consumer, as well as reducing waste that normally results when appliances like microwave ovens that are subject to arcing are discarded because they can not be repaired or refurbished.

Figure 1:
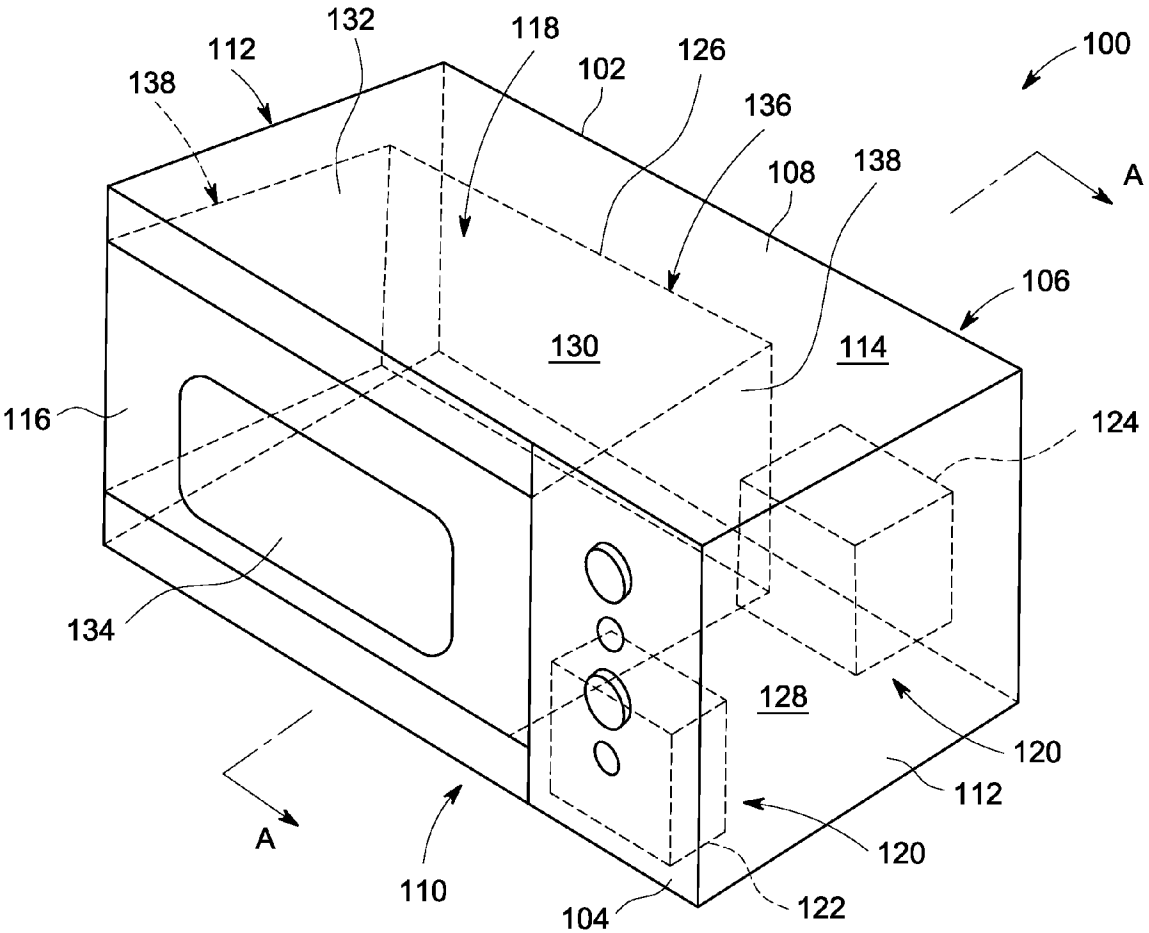
FIG. 1 is a front, perspective view of a cooking appliance such as a microwave oven in which is implemented an exemplary embodiment of a sacrificial component.
Figure 2:
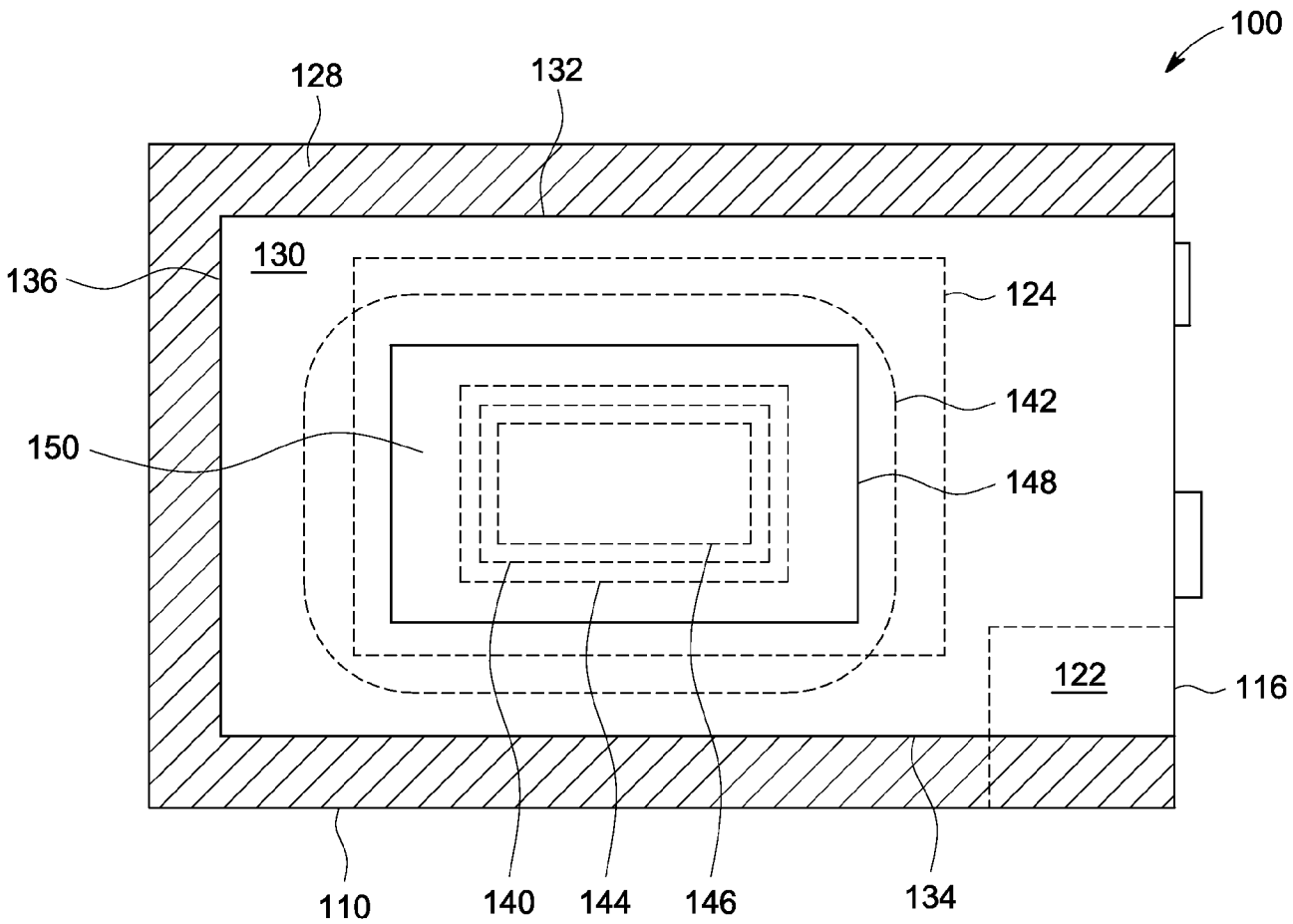
FIG. 2 is a side, cross-section of the cooking appliance of FIG. 1.

By way of example, reference can now be had to FIGS. 1 and 2, in which these concepts are implemented on a cooking appliance 100 that includes a magnetron. One non-limiting example of such a cooking appliance 100 is a microwave oven. The cooking appliance 100 includes an outer housing 102 generally configured to permit placement of the cooking appliance 100 on a counter or secured to kitchen cabinetry or a kitchen wall. The outer housing 102 is configured with a front panel 104, a rear wall 106, a top wall 108, a bottom wall 110, and pair of opposed side walls 112. Combined together the walls of the outer housing 102 form an interior cabinet 114, accessed by way of a door 116 and which surrounds a heated cavity 118 and components 120 such as a power supply 122 and a magnetron 124.

The heated cavity 118 also includes a cavity wall 126 that serves to separate the interior cabinet 114 into a component compartment 128 and a cooking compartment 130, the latter provided to subject food to radiation from, e.g., the magnetron 124. The cavity wall 126 in this example includes a top cavity wall 132, a bottom cavity wall 134, a rear cavity wall 136, and a pair of opposed side cavity walls 138. As best illustrated in FIG. 2, the cavity wall 126 such as the side cavity wall 138 includes an opening 140 for permitting radiation into the heated cavity 118. The side cavity wall 138 is likewise demarcated in FIG. 2 with a sacrificial region 142, in which there is found a sacrificial component 144 with an aperture 146 disposed in communication with the opening 140. An aperture cover 148 is also provided with a covering member 150 disposed over the aperture 146, which in cooking applications prevents debris such as grease from contaminating areas proximate the aperture 146.

Aperture 146 is provided to permit radiation from, e.g., the magnetron, to pass through the sacrificial component 144 and into the heated cavity 118. Shapes of the aperture 146 can vary, wherein in addition to shapes such as rectangular (pictured in FIG. 2) and/or generally quadrilateral, the aperture 146 can also be circular, elliptical, or oblong, as well. Likewise the size and other configurative dimensions such as the length and width of the aperture 146 can also vary as required by the design and construction of, e.g., the cooking appliance 100.

The sacrificial component 144 is preferably metallic and/or comprised of material that is substantially impervious to radiation emitted by the magnetron 124. Shape and dimensions are generally negligible, with such features being determined in accordance with other design parameters such as the dimensions of the cavity wall 126 and the dimensions of the opening 140. Mounting of the sacrificial component 144 is selected so that the aperture 146 is positioned with respect to the opening 140. In one example, this position is selected to permit radiation from the magnetron 124 to properly impinge on the heated cavity 118. Proper positioning of the opening 140 and the aperture 146, for example, is generally set by way of characteristics effectuating cooking of the food in the heated cavity 118.

To facilitate repair of the cooking appliance 100 as discussed above, the sacrificial component 144 is configured both for removal from its location within the cooking appliance 100, as well as for replacement with another component of the type contemplated by the sacrificial component 144. This configuration permits the aperture 146 to be repaired after arcing without executing further repairs to, e.g., the cavity wall 126. In one example, the sacrificial component that is subject to damage by arcing is removed and replaced with a new, undamaged sacrificial component, which permits operation of the cooking appliance 100 as before the damage occurred.

In one embodiment, the sacrificial component 144 is coupled, either directly or indirectly, to the cavity wall 126. Locating the sacrificial component 144 may require registration with portions of the cavity wall 126 to provide the relative position of the aperture 146 with the opening 140 discussed above. This registration can be achieved by pins, screws, surfaces, and other features of the cavity wall 126, the sacrificial component 144, and the aperture cover 148. Such features can be configured to relate the location of the aperture 146 to the opening 140 when the sacrificial component 144 is positioned in the cooking appliance 100. Fasteners such as screws and bolts, as well as other fastening mechanisms such as snaps, rivets, and hooks are suitable to couple the sacrificial component 144 to the cavity wall 126, to couple the sacrificial component 144 to the aperture cover 148, and also to couple the aperture cover 148 to the cavity wall 126.

In one embodiment, the sacrificial component 144 is coupled to the magnetron 124, thus rendering the sacrificial component 144 removable and replaceable by way of decoupling the magnetron 124 from the cooking appliance 100. Exemplary configurations of the sacrificial component 144 and the magnetron 124 can have these two components coupled directly such as by affixing the sacrificial component 144 to portions of the magnetron 124. In other examples, the sacrificial component 144 is coupled indirectly to the magnetron 124 via a secondary component such as a waveguide that is secured to the magnetron 124.

Figure 3:
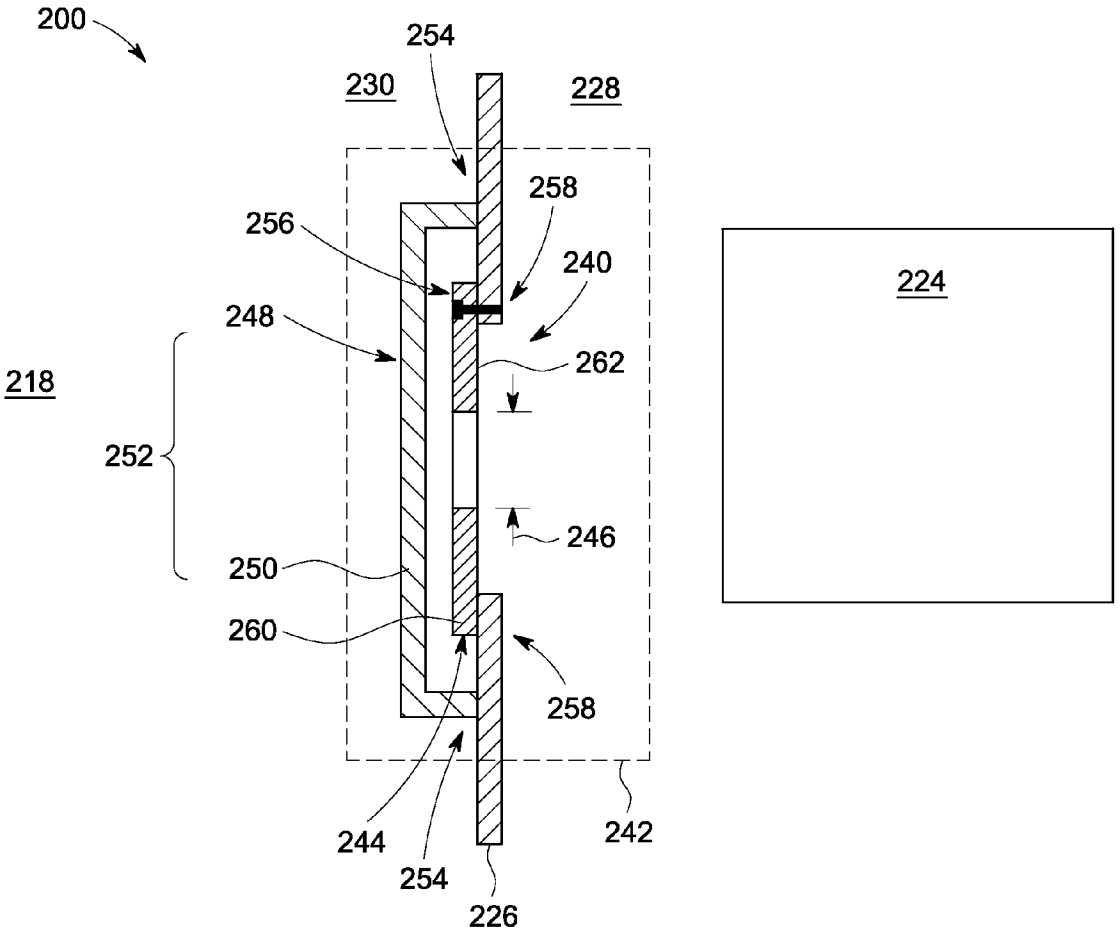
FIG. 3 is a side, schematic representation of another exemplary embodiment of a sacrificial component.
Figure 4:
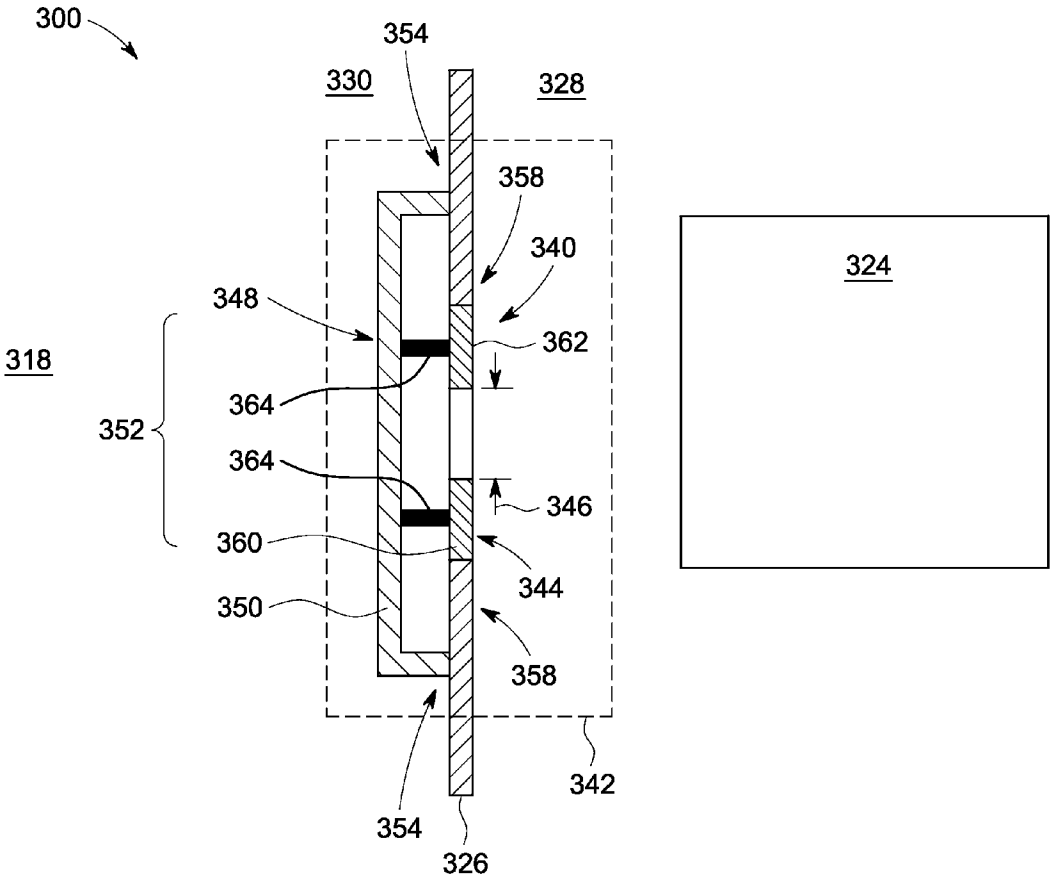
FIG. 4 is a side, schematic representation of yet another embodiment of a sacrificial component.

Reference is now focused on the FIGS. 3 and 4 and the discussion below, wherein the examples depicted in the FIGS. 3 and 4 provide, in general schematic construction, examples of a cooking appliance 200 (FIG. 3) and 300 (FIG. 4) in which is implemented the concepts of the present disclosure. Like numerals are used where applicable to identify like components as between FIGS. 1-4, but the numerals are increased by 100 (e.g., 100 is 200 in FIG. 3 and 200 is 300 in FIG. 4). Moreover, some portions of the cooking appliance 200 and 300 have been removed for clarity, focusing rather on the area proximate the sacrificial region (e.g., the sacrificial region 142 of FIG. 2). It is contemplated, however, that although features may be missing from the examples of FIGS. 3 and 4, these examples can include and comprise any one of the features discussed above and contemplated within the scope and spirit of the present disclosure.

Turning first to the cooking appliance 200 of FIG. 3, there is depicted a heated cavity 218 and a magnetron 224 for injecting radiation into the heated cavity 218. The heated cavity 218 is defined by at least one cavity wall 226 that forms a component compartment 228 and a cooking compartment 230. The cavity wall 226 includes an opening 240 for radiation to enter the heated cavity 218. The opening 240 is found in a sacrificial region 242, which includes a sacrificial component 244 with an aperture 246 in communication with the opening 240. An aperture cover 248 with a covering member 250 is also illustrated, shown in this example in a mounted configuration 252 that prevents debris from settling on or near the aperture 246. The mounted configuration 252 utilizes one or more mounting points 254 whereby the aperture cover 248 can interface with the cavity wall 226. A fastening mechanism 256 such as a screw, pin, bolt, or other device is provided to secure, and in one construction to releasably secure, the sacrificial component 244 to the cavity wall 226. In one embodiment, the fastening mechanism 256 is secured to one or more mounting locations, generally designated 258, into which the fastening mechanism 256 can extend so as to secure the sacrificial component 244 to the cavity wall 226. The mounting areas 258 are located about the periphery of the sacrificial component 244, each being receptive to the fastening mechanism 256 selected for use in the cooking appliance 100.

As also depicted in the example of FIG. 3, the sacrificial component 244 includes a plate 260 with at least one surface 262 that abuts the cavity wall 226. The plate 260 is constructed of conductive material such as, for example, sheet metal in which the aperture 246 is drilled or otherwise machined therein. In one embodiment, the plate 260 is wholly located in the heated cavity 218. Various other configurations of the plate 260 and/or the sacrificial component 244 are contemplated wherein portions of the plate 260 (and/or the sacrificial component 244) extend into or is otherwise disposed in the opening 240. Such portions can be constructed by machining the plate 260 to form a boss, a protrusion, or similar stepped featured wherein a first surface abuts the cavity wall 226 and the resulting boss (or protrusion) extends into the opening 240. In another embodiment, the sacrificial component 244 can be located, either wholly or partially, in the component compartment 228 such as by mounting the sacrificial component 244 to surfaces of the cavity wall 226 opposite the heated cavity 218. Mounting in the component compartment 228 is likewise facilitated by providing the sacrificial component 244 as part of or coupled to the magnetron 224 and its associated components (e.g., a waveguide (not shown)).

The aperture cover 248 is located in surrounding relation to the sacrificial component 244. The mounting areas 258 can incorporate various fastening devices (e.g., screws), as well as design configurations that facilitate release of the aperture cover 248 during repair. Such configurations can include, but are not limited to, snap fittings, pin-and-slot arrangements, quick-release interfaces, and like configurations so that portions of the aperture cover 248 can interface with the cavity wall 226.

During repair of the cooking appliance (e.g., the cooking appliance 100 and 200), an end user such as an operator or a repair technician can remove the aperture cover 248 to expose the plate 260. The end user can then remove the plate 260 with damage such as by removing the fastening mechanism 256 to decouple the plate 260 from the cavity wall 226. By inserting another one of the plate 260, constructed in accordance with the concepts herein, in place of the damaged plate and replacing the aperture cover 248, the user completes repair and thus restores operation of the cooking appliance 100.

Referring next to FIG. 4, repairs such as those discussed above are facilitated by the configuration of the cooking appliance 300. In this example, the cooking appliance 300 includes a heated cavity 318, a magnetron 324, and a cavity wall 326 separating the cooking appliance 300 into a component compartment 328 and a cooking compartment 330. The cavity wall 326 has an opening 340 located in a sacrificial region 342. Disposed in the opening 340 is a sacrificial component 344 with an aperture 346 suited to permit radiation to pass through the sacrificial component 344 and into the heated cavity 318. There is also provided an aperture cover 348 with a covering member 350, shown in its mounted configuration 352 at mounting points 354 and placing the aperture cover 348 at or near mounting areas 358. In the construction illustrated in FIG. 4, the plate 360 is coupled to the aperture cover 348 at one or more coupling locations 364.

Although illustrated as being wholly disposed in the opening 340, the plate 360 can also have portions that extend or overlap with the cavity wall 326. These portions can be formed in or as part of the surface 362. Any of such portions can be located interior to the heated cavity 318, thus facilitating removal of the sacrificial component 344 in connection with displacement of the aperture cover 348. Coupling such as at the coupling locations 364 can include snap and rivets, as well as any of the other fastening mechanisms contemplated herein.

Repair of cooking appliances such as the cooking appliance 300 is somewhat simplified with respect to the example of FIG. 3 discussed above. By way of example, the end user can remove the aperture cover 348 to decouple the sacrificial component 344 from the opening 340. The plate 360 is then removed from the aperture cover 348, the damaged component (e.g., non-limiting examples of the plate 360) is replaced with an undamaged component (e.g., the plate 360), and the aperture cover 348 is repositioned back inside of the heated cavity 318.

In view of the forgoing discussion, while the concepts of repair have been presented in connection with microwave ovens (e.g., the cooking appliance 100, 200, and 300), implementation of these concepts can extend to other appliances. Stoves, ranges, ovens, and other devices can be outfitted with radiative elements such as magnetrons to facilitate cooking and preparation of food. Arcing and failure modes addressed by the sacrificial component (e.g., the sacrificial component 144, 244, and 344) of the present disclosure can be implemented as part of the design and integration of such radiative elements.

Moreover, it is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A cooking appliance, comprising:

a magnetron providing radiation;

a heated cavity comprising a cavity wall defining an opening exposing the heated cavity to the radiation, the opening in the cavity wall defining a closed perimeter; and a sacrificial component defining an aperture in communication with the opening to permit radiation to pass through the sacrificial component and into the heated cavity, wherein the sacrificial component is removable from the heated cavity and is positioned inside of the heating cavity and in proximity to the magnetron, and wherein the aperture in the sacrificial component is sized and shaped so that no portion of the aperture extends beyond the closed perimeter of the opening in the cavity wall.

2. A cooking appliance according to claim 1, further comprising a cover disposed over the aperture.

3. A cooking appliance according to claim 2, wherein the sacrificial component is coupled to the cover, and wherein the cover is secured to the cavity wall of the heated cavity.

4. A cooking appliance according to claim 3, wherein the sacrificial component is removable from the cover.

5. A cooking appliance according to claim 1, further comprising a fastening mechanism securing the sacrificial component to the cavity wall of the heated cavity.

6. A cooking appliance according to claim 5, wherein the fastening mechanism attaches to the cavity wall so as to position the sacrificial component inside of the heated cavity.

7. A cooking appliance according to claim 1, wherein the sacrificial component is coupled to the magnetron.

8. A cooking appliance according to claim 7, wherein the magnetron comprises a waveguide, wherein the waveguide is aligned with the aperture of the sacrificial component, and wherein the sacrificial component is coupled to the waveguide.

9. A cooking appliance according to claim 1, wherein the opening is in a side cavity wall of the heated cavity.

10. A cooking appliance according to claim 1, wherein a portion of the sacrificial component is disposed in the opening.

11. In a microwave oven with a heated cavity for cooking food therein, the heated cavity comprising a cavity wall with a top cavity wall, a bottom cavity wall, a rear cavity wall, and a pair of opposing side cavity walls, the heated cavity exposed to radiation from a magnetron via an opening in the cavity wall, the opening in the cavity wall defining a closed perimeter, said microwave oven comprising:

a sacrificial component defining an aperture therethrough positioned with respect to the opening so as to permit radiation to pass to the heated cavity through the sacrificial component, wherein the sacrificial component is positioned inside of the heating cavity in proximity to the magnetron and is secured to the heated cavity in a manner that permits the sacrificial component to be removed from said microwave oven, and wherein the aperture in the sacrificial component is sized and shaped so that no portion of the aperture extends beyond the closed perimeter of the opening in the cavity wall.

12. A microwave oven according to claim 11, wherein the sacrificial component is secured to one of the pair of opposing side cavity walls.

13. A microwave oven according to claim 11, further comprising:

a cover having a covering member extending over the aperture, wherein the cover is secured to the cavity wall of the heated cavity to position the cover in the heated cavity.

14. A microwave oven according to claim 13, wherein the sacrificial component and the cover are coupled together so that removing the cover from the heated cavity causes the aperture to be displaced from its position in communication with the opening.

15. A microwave oven according to claim 11, further comprising a fastening mechanism coupling the sacrificial component to the cavity wall of the heated cavity.

16. A microwave oven according to claim 11, wherein the sacrificial component is coupled to the magnetron, and wherein removal of the sacrificial component requires the magnetron to be removed from said microwave oven.

17. A microwave oven, comprising:

a magnetron;

a heated cavity receiving radiation from the magnetron, the heated cavity including a cavity wall defining an opening exposing the heated cavity to the radiation, the opening in the cavity wall defining a closed perimeter;

a cover coupled to the cavity wall, the cover comprising a surface covering the opening;

a plate located between the surface and the cavity wall, the plate defining an aperture in communication with the opening to permit radiation to pass through the plate and into the heated cavity during operation of the magnetron, wherein the plate is removable from the heated cavity and is positioned outside inside of the heating cavity in proximity to the magnetron, and wherein the aperture in the plate is sized and shaped so that no portion of the aperture extends beyond the closed perimeter of the opening in the cavity wall.

18. A microwave oven according to claim 17, wherein the plate is coupled to the cover so that removing the cover from the heated cavity displaces the aperture to be displaced from its position in communication with the opening.

19. A microwave oven according to claim 17, further comprising a waveguide coupled to the magnetron, wherein the plate is coupled to the waveguide so that removing the magnetron from said microwave displaces the aperture from its position in communication with the opening.

20. A microwave oven according to claim 17, wherein the plate is coupled to the cavity wall.

* * * * *